US006008741A

United States Patent [19]

Shinagawa et al.

[11] Patent Number: 6,008,741

[45] Date of Patent: Dec. 28, 1999

[54] INTERSECTION INFORMATION SUPPLY APPARATUS

[75] Inventors: Masahiko Shinagawa, Susono; Kenji Sasaki, Gotenba, both of Japan

[73] Assignee: Toyota Jidosha Kabushiki Kaisha, Aichi-ken, Japan

[21] Appl. No.: 09/161,722

[22] Filed: Sep. 29, 1998

[30] Foreign Application Priority Data

Sep. 30, 1997 [JP] Japan ..... 9-266842

[51] Int. Cl.[6] ..... G08G 1/095

[52] U.S. Cl. ..... 340/907; 340/907; 340/436; 340/928; 340/905; 340/917; 340/919; 340/906; 340/933; 340/916; 340/910; 701/117; 701/59; 701/53

[58] Field of Search ..... 340/907, 436, 340/928, 905, 917, 919, 906, 933, 916, 910; 701/117, 59, 53

[56] References Cited

U.S. PATENT DOCUMENTS

| | | | |
|---|---|---|---|
| 3,582,876 | 6/1971 | Carmack | 340/37 |
| 4,321,589 | 3/1982 | King | 340/38 L |
| 4,896,153 | 1/1990 | Postorino | 340/906 |
| 4,908,616 | 3/1990 | Walker | 340/929 |
| 5,777,564 | 7/1998 | Jones | 340/917 |

FOREIGN PATENT DOCUMENTS

| | | | |
|---|---|---|---|
| 57-117096 | 7/1982 | Japan | G08G 1/00 |

*Primary Examiner*—Jeffery A. Hofsass
*Assistant Examiner*—Tai T. Nguyen
*Attorney, Agent, or Firm*—Finnegan, Henderson, Farabow, Garrett & Dunner, L.L.P.

[57] ABSTRACT

An intersection information supply apparatus includes a table indicating relationships between approaching directions of a vehicle to an intersection and signal forms, an approaching direction detecting unit detecting an approaching direction in which the vehicle is approaching the intersection, a transmission unit transmitting a signal having a signal form indicated in the table so as to correspond to the approaching direction detected by the approaching direction detecting unit, a signal obtaining unit selectively obtaining, from among signals externally arriving at the vehicle, a signal having a signal form indicated in the table so as to correspond to an approaching direction relevant to the approaching direction detected by the approaching direction detecting unit and an information output unit outputting information about presence of another vehicle when the signal obtaining unit obtains the signal.

12 Claims, 6 Drawing Sheets

FIG. 5

| TAG | DIRECTION | TRANSMISSION CARRIER | RECEIVED CARRIER |
|---|---|---|---|
| Ta | STRAIGHT | $a_0$ | $b_0$, $d_0$, $c_1$, $b_1$, $d_1$, $d_2$ |
| | RIGHT TURN | $a_1$ | $b_0$, $d_0$, $c_0$, $b_1$, $d_1$, $c_2$ |
| | LEFT TURN | $a_2$ | $b_0$, $c_1$ |
| Tb | STRAIGHT | $b_0$ | $a_0$, $c_0$, $d_1$, $a_1$, $c_1$, $a_2$ |
| | RIGHT TURN | $b_1$ | $a_0$, $c_0$, $d_0$, $a_1$, $c_1$, $d_2$ |
| | LEFT TURN | $b_2$ | $c_0$, $d_1$ |
| Tc | STRAIGHT | $c_0$ | $b_0$, $d_0$, $a_1$, $b_1$, $d_1$, $b_2$ |
| | RIGHT TURN | $c_1$ | $b_0$, $d_0$, $a_0$, $b_1$, $d_1$, $a_2$ |
| | LEFT TURN | $c_2$ | $d_0$, $a_1$ |
| Td | STRAIGHT | $d_0$ | $a_0$, $c_0$, $b_1$, $a_1$, $c_1$, $c_2$ |
| | RIGHT TURN | $d_1$ | $a_0$, $c_0$, $b_0$, $a_1$, $c_1$, $b_2$ |
| | LEFT TURN | $d_2$ | $a_0$, $b_1$ |

INTERSECTION INFORMATION SUPPLY APPARATUS

BACKGROUND OF THE INVENTION

1. Field of the Invention

The present invention relates to an intersection information supply apparatus which supplies, to a driver of a vehicle approaching an intersection or existing in the intersection, information about another vehicle approaching the intersection 2. Description of the Related Art Conventionally, to prevent accidents in an intersection, a system informing a driver of a vehicle which is going to turn right or left at the intersection of presence of a two-wheeled vehicle approaching the intersection from an opposite side or running in the left side of the vehicle has been proposed (Japanese Laid-Open Patent Application No.57-117096).

In the system, if a two-wheeled vehicle approaching an intersection is detected, the following processes are carried out. If there is a possibility of a collision between the two-wheeled vehicle and a vehicle which is approaching the intersection to turn left (a left-turn vehicle), a warning signal is transmitted from a transmitter (a main control apparatus) installed on the roadside to the left-turn vehicle. In addition, if there is a possibility of a collision between the two-wheeled vehicle and a vehicle which is approaching the intersection to turn right (a right-turn vehicle), a warning signal is transmitted from the transmitter (the main control apparatus) to the right-turn vehicle. In each of the left-turn vehicle and the right-turn vehicle, a warning (display and/or sound) based on the received warning signal is issued.

According to such a system, a collision between a right-turn vehicle and a two-wheeled vehicle approaching from the opposite side and an accident in which a two-wheeled vehicle is caught under the left-turn vehicle can be prevented.

However, in the system as described above, the warning signal does not include information indicating from which directions right and left-turn vehicles approaching the intersection should receive the warning signal. For example, when right-turn vehicles and left-turn vehicles are simultaneously approaching the intersection on the respective up and down lanes (at least four vehicles), it is not determined which vehicle should receive a warning signal transmitted from the transmitter on the roadside. Thus, in a vehicle approaching the intersection or existing in the intersection, a useless warning may be issued.

SUMMARY OF THE INVENTION

Accordingly, the general object of the present invention is to provide a novel and useful intersection information supply apparatus in which the disadvantages of the aforementioned prior art are eliminated.

A more specific object of the present invention is to provide an intersection information supply apparatus which can prevent useless information from being supplied to a driver of a vehicle approaching an intersection or existing in the intersection.

The objects of the present invention are achieved by an intersection information supply apparatus comprising: a table indicating relationships between approaching directions of a vehicle to an intersection and signal forms; approaching direction detecting means for detecting an approaching direction in which the vehicle is approaching the intersection; transmission means for transmitting a signal having a signal form indicated in the table so as to correspond to the approaching direction detected by the approaching direction detecting means; signal obtaining means for selectively obtaining, from among signals externally arriving at the vehicle, a signal having a signal form indicated in the table so as to correspond to an approaching direction relevant to the approaching direction detected by the approaching direction detecting means; and information output means for outputting information about presence of another vehicle when the signal obtaining means obtains the signal.

When a vehicle having the intersection information supply apparatus is approaching the intersection from an approaching direction, the transmission means transmits a signal having a signal form indicated in the table so as to correspond to the direction detected by the approaching direction detecting means. In the same manner as the above vehicle, when each of other vehicles having the intersection information supply apparatus is approaching the intersection from an approaching direction, a signal having a signal form indicated in the table is transmitted from each of the other vehicles.

In this situation, in the intersection information supply apparatus of the vehicle, the signal obtaining means selectively obtains, from among signals externally transmitted to the vehicle from the other vehicles, a signal having a signal form indicted in the table so as to correspond to an approaching direction relevant to the detected approaching direction. At this time, the information about the presence of another vehicle output by the information output means is supplied to a driver of the vehicle.

The driver can recognize that another vehicle is approaching from the approaching direction relevant to the detected approaching direction.

It is preferable that an approaching direction relevant to the detected approaching direction be decided based on whether there is a possibility that another vehicle approaching the intersection from the relevant approaching direction will affect driving operations of the vehicle approaching the intersection from the detected approaching direction. As a result, the driver can recognize that there is another vehicle capable of affecting the driving operations.

The signal obtaining means may receive all signals arriving at the vehicle and select the signal having the signal form from among the received signals. In addition the signal obtaining means may also selectively receive the signal having the signal form.

The necessity to inform the driver of the vehicle of presence of another vehicle depends on the running state (the vehicle speed, the acceleration/deceleration and the like) of the vehicle approaching the intersection. For example, in a case where a vehicle is approaching the intersection at a high speed, the necessity to inform the driver of the presence of the vehicle is high. In addition, it is preferable that useless information be prevented from being supplied to the driver of the vehicle.

From the above point of view, the intersection information supply apparatus according to the present invention may further comprise running state detecting means for detecting a running state of the vehicle; and transmission control means for controlling, based on the running state detected by the running state detecting means, whether the transmission means transmits the signal.

To inform of the presence of a vehicle rapidly approaching the intersection, the above running state to be detected by the running state detecting means may include a vehicle speed, and the transmission control means may control, based on vehicle speeds detected at respective positions before the intersection, whether the transmission means transmits the signal.

Further, there may be a plurality of passing states in which a vehicle passes through the intersection (straightly running through the intersection, turning right at the intersection and turning left at the intersection). Vehicles to which drivers of the vehicles passing through the intersection in the plurality of passing states should pay attention differ from each other. Thus, the present invention may be the intersection information supply apparatus wherein the table indicates relationships between passing states of the vehicle and the signal forms for each of the approaching directions, each of the passing states of the vehicle representing how the vehicle passes through the intersection, the intersection information supply apparatus further comprising: determination means for determining a passing state in which the vehicle is going to pass through the intersection, wherein the transmission means transmits the signal having the signal form indicated in the table so as to correspond to the approaching direction detected by the approaching direction detecting means and the passing sate determined by the determination means, and wherein the signal obtaining means selectively obtains the signal having the signal form indicted in the table so as to correspond to a passing state in another approaching direction relevant to the approaching direction detected by the approaching direction detecting means and the passing state determined by the determination means.

According to the intersection information supply apparatus as described above, the driver of the vehicle can recognize, based on the information output by the information output means, the presence of another vehicle which is going to pass through the intersection in a passing state in another approaching direction relevant to the passing state and the approaching direction of the vehicle of the driver. It is preferable that another passing state in an approaching direction relevant to the detected approaching direction and the determined passing state be decided based on whether there is a possibility that another vehicle approaching the intersection from the relevant approaching direction and going to pass through the intersection in the relevant passing state will affect driving operations of the vehicle approaching the intersection from the detected approaching direction and going to pass through the determined passing state. As a result, the driver can recognize that there is another vehicle capable of affecting the driving operations.

BRIEF DESCRIPTION OF THE DRAWINGS

Other objects, features and advantages of the present invention will be apparent from the following description when read in conjunction with the accompanying drawings, in which:

FIG. 5 is a table illustrating relationships among approaching directions, states in which a vehicle passes through the intersection, transmission carriers and received carriers;

DESCRIPTION OF THE PREFERRED EMBODIMENTS

A description will be given of an embodiment of the present invention.

Figure 1:
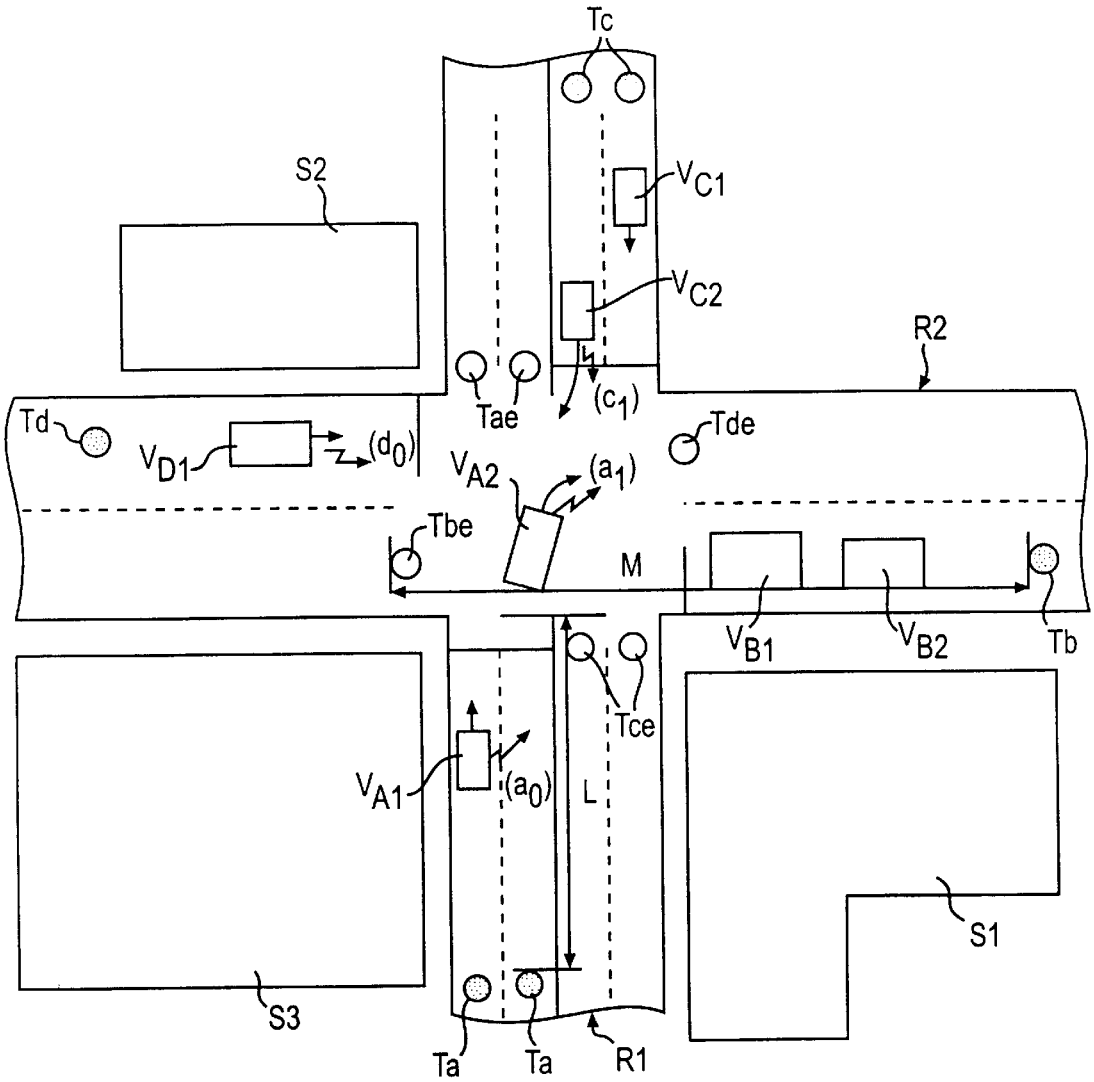
FIG. 1 is a drawing illustrating a state of an intersection through which a vehicle having an intersection information supply apparatus according to an embodiment of the present invention passes.

FIG. 1 shows an example of an intersection through which a vehicle (an AHS vehicle) having an intersection information supply apparatus according to the embodiment of the present invention passes.

Referring to FIG. 1, a road R1 having two lanes in each side and a road R2 having one lane in each side intersect. Buildings S1, S2 and S3 are built near three corners of the intersection, so that it is difficult for drivers of vehicles approaching the intersection from respective directions to see other vehicles approaching the intersection from other directions.

Transponders Ta and Ta are installed at positions L meters before the intersection on the lanes, of the road R1, extending to the intersection from a direction (from a downward position in FIG. 1). Each of the transponders Ta and Ta is a magnetic induction tag (hereinafter, referred to as a tag). Tags Tc and Tc are installed at positions L meters before the intersection on the opposite lanes, of the road R1, extending to the intersection from the opposite direction (from an upward position in FIG. 1). A tag Tb is installed at a position L meters before the intersection on the lane, of the road R2, extending to the intersection from a direction (from a rightward position in FIG. 1). A tag Td is installed at a position L meters before the intersection on the opposite lane, of the road R2, extending to the intersection from the opposite direction (from a leftward position in FIG. 1).

These tags Ta, Tb, Tc and Td are supplied with power, for example, from an external unit and emit predetermined signals (electric waves). Each of the signals includes at least information about a direction to the intersection (indicating from which direction a vehicle is approaching the intersection) and information indicating a position L meters before the intersection.

Ending tags Tae, Tbe, Tce and Tde are installed near the exits of the intersection on the lanes on which the tags Ta, Tb, Tc and Td are installed so as to correspond to the tags Ta, Tb, Tc and Td. Each of the ending tags emits information indicating a position at which the watching is ended. The distance between each of the tags Ta, Tb, Tc and Td and a corresponding one of the ending tags Tae, Tbe, Tce and Tde is set at M meters.

Figure 2:
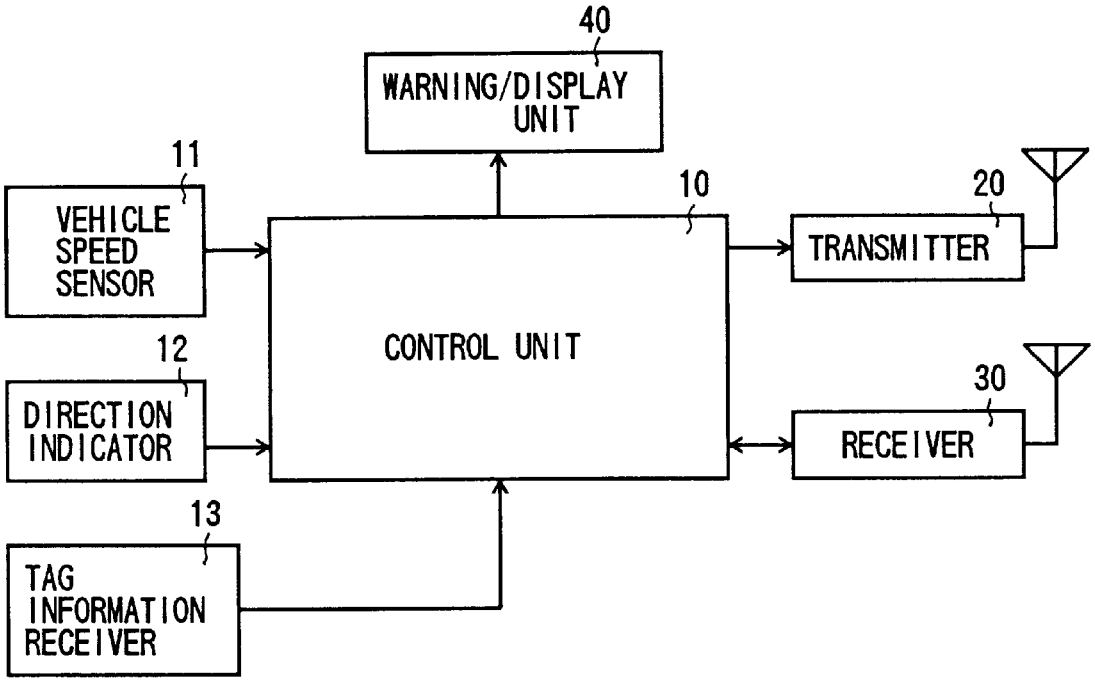
FIG. 2 is a block diagram illustrating an intersection information supply apparatus according to an embodiment of the present invention.

An intersection information supply apparatus according to the embodiment of the present invention is formed as shown in FIG. 2.

Referring to FIG. 2, the intersection information supply apparatus which is provided in a vehicle has a control unit 10, a transmitter 20, a receiver 30 and a warning/display unit 40. The control unit 10 controls the transmitter 20 based on detecting signals from a vehicle speed sensor 11, turn signals from a direction indicator 12 and information from a tag information receiver 13 which receives signals from the tags (the detailed control will be described later). In addition, the control unit 10 controls the warning/display unit 40 based on the detecting signal from the vehicle speed sensor 11 and information received by the receiver 30 (the detailed control will be described later).

The control unit 10 has a memory unit (e.g., a ROM). Table information as shown in FIG. 5 is stored in the memory unit. In the table information, for each of approaching directions to the intersection identified by the tags Ta, Tb, Tc and Td, transmission frequencies (transmission carriers) are defined. The transmission frequency corresponds to a passing state in which the vehicle passes through the intersection (a straight passing state, a right-turn state or a left-turn state).

In the table information shown in FIG. 5, for an approaching direction from the tag Ta to the intersection (from the downward position in FIG. 1), a carrier (a frequency) a0 corresponding to the straight passing state, a carrier a1 corresponding to the right-turn state and a carrier a2 corresponding to the left-turn state are defined. For an approaching direction from the tag Tb to the intersection (from the rightward position in FIG. 1), a carrier b0 corresponding to the straight passing state, a carrier b1 corresponding to the right-turn state and a carrier b2 corresponding to the left-turn state are defined. For an approaching direction from the tag Tc to the intersection (from the upward position in FIG. 1), a carrier c0 corresponding to the straight passing state, a carrier c1 corresponding to the right-turn state and a carrier c2 corresponding to the left-turn state are defined. Further, for an approaching direction from the tag Td to the intersection (from the leftward position in FIG. 1), a carrier d0 corresponding to the straight passing state, a carrier d1 corresponding to the right-turn state and a carrier d2 corresponding to the left-turn state are defined.

In each of the approaching directions to the intersection, another vehicle to which the driver of the vehicle should pay attention depends on a passing state in which the vehicle passes through the intersection (the straight passing state, the right-turn state or the left-turn state). The driver of the vehicle should pay attention to other vehicles crossing a lane on which the vehicle is running or entering. From this point of view, in the table information shown in FIG. 5, for each of the approaching directions to the intersection identified by the respective tags Ta, Tb, Tc and Td, a carrier (a frequency) of a signal corresponding to the passing state and the approaching direction of a vehicle to which the driver of the vehicle passing through the intersection in each of the passing states (the straight passing state, the right-turn state and the left-turn state) should pay attention is defined as a received carrier.

For example, in the approaching direction from the tag Ta to the intersection (see FIG. 1), the driver of the vehicle passing through the intersection in the straight passing state should pay attention to a vehicle which is approaching the intersection from the tag Tb and going to pass through the intersection in the straight passing sate (a straight running vehicle) and a straight running vehicle which is approaching the intersection from the tag Td. In this case, the driver should further pay attention to each of vehicles which are approaching the intersection from the tags Tc, Tb and Td and going to turn right (a right-turn vehicle) and a vehicle which is approaching to the intersection from the tag Td and going to turn left (a left-turn vehicle). Thus, in this case, for "the straight" approaching direction from the tag Ta to the intersection, the respective carriers b0, d0, c1, b1, d1 and d2 are set as the received carriers.

Figure 6:
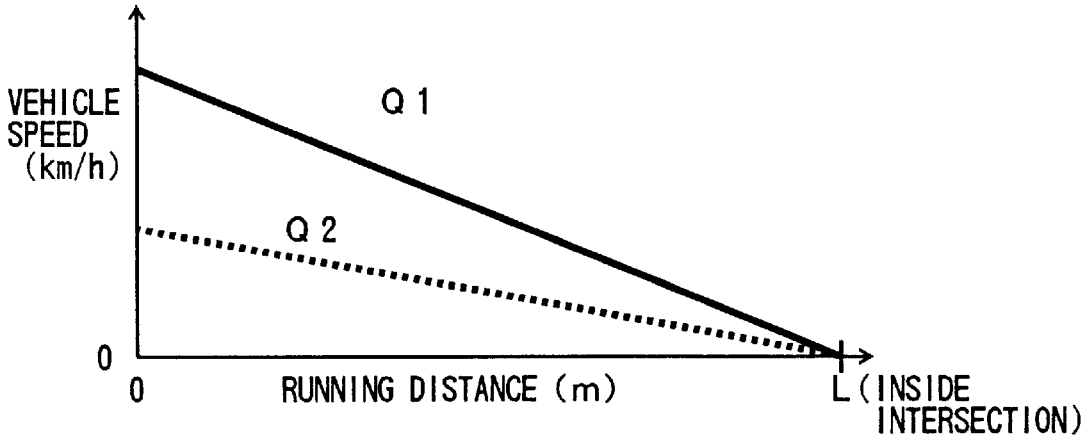
FIG. 6 is a map illustrating transmission and receiving conditions of a signal (the first)
Figure 7:
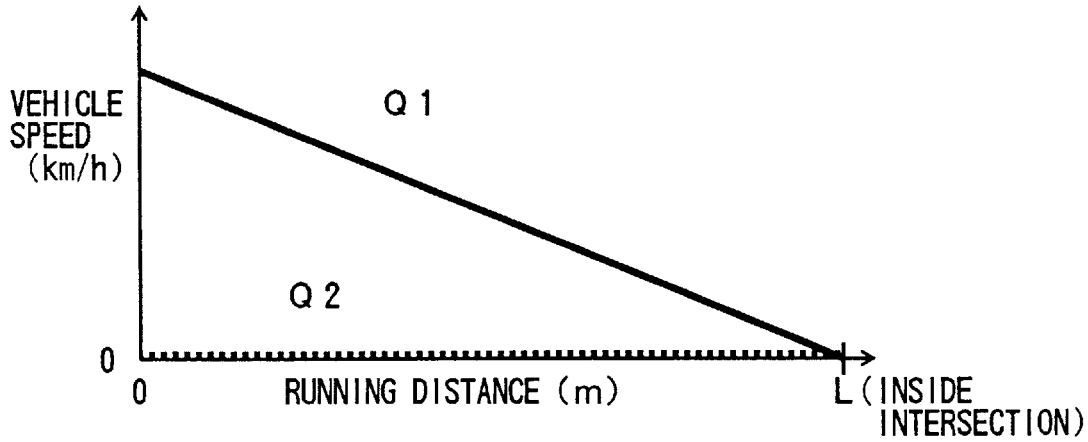
FIG. 7 is a map illustrating transmission and receiving conditions of a signal (the second).

In the memory unit of the control unit 10, condition map information as shown in FIGS. 6 and 7 is stored in addition to the table information as described above. The condition map information indicates a transmission condition of the transmitter 20 and a receiving condition in the receiver 30.

The condition map shown in FIG. 6 indicates the transmission condition and the receiving condition applied to an intersection at which traffic signals are installed. That is, if a vehicle speed (an axis of ordinate) at each position (an axis of abscissa) between a detecting position of the tag (an origin) and the intersection is on or exceeds a first characteristic line Q1, a signal having a transmission carrier indicating the presence of the vehicle approaching the intersection is transmitted. On the other hand, if the vehicle speed at each position is below the first characteristic line Q1, the signal is not transmitted. In addition, if the vehicle speed at each position between the detecting position of the tag and the intersection is on or exceeds a second characteristic line Q2, the received carriers are watched. On the other hand, if the vehicle speed at each position is below the second characteristic line Q2, the received carriers are not watched. The above conditions mean that information about the presence of a vehicle approaching the intersection at a relatively low speed is not supplied.

In a case where the vehicle is in the intersection, the signal (having the transmission carrier) indicating the presence of the vehicle is transmitted and the received carriers are watched, regardless of the vehicle speed.

The condition map shown in FIG. 7 indicates the transmission condition and the receiving condition applied to an intersection at which no traffic signal is installed. In this case, there is a difference from the condition map shown in FIG. 6 in that the second characteristic line Q2 indicates that the vehicle speed is "0". That is, the received carriers are watched regardless of the vehicle speed.

Figure 3:
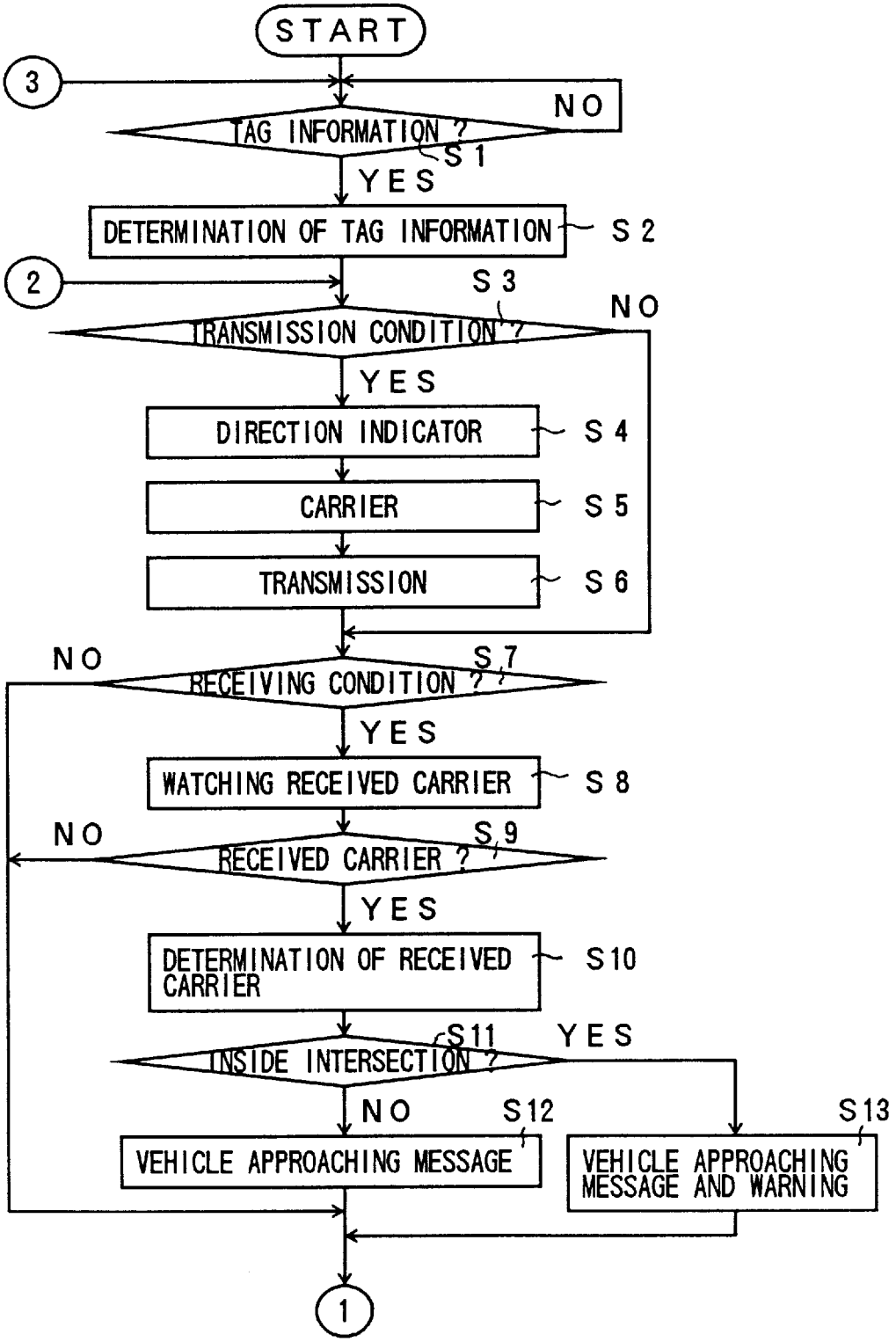
FIG. 3 is a flowchart illustrating a process for supplying information about an intersection (the first)
Figure 4:
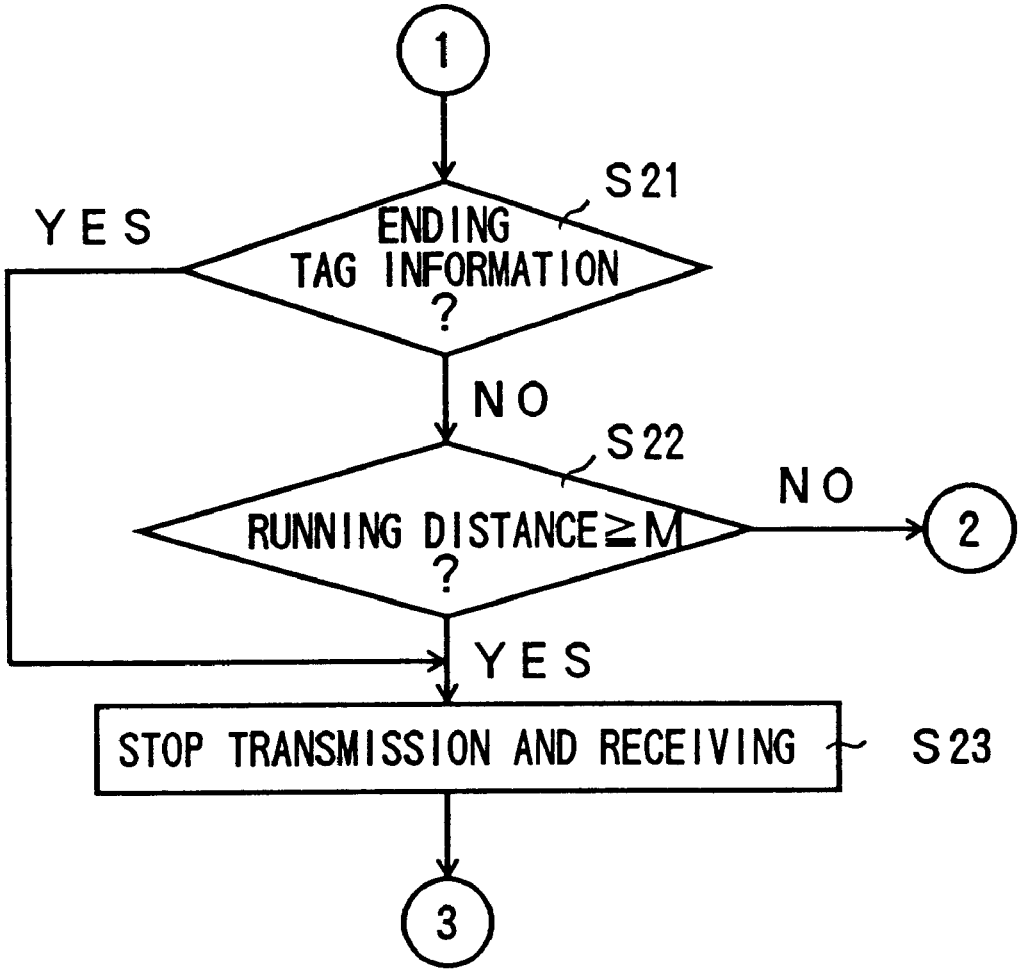
FIG. 4 is a flowchart illustrating a process for supplying information about an intersection (the second)

When the vehicle provided with the intersection information supply apparatus as described above is approaching and passes through the intersection as shown in FIG. 1, the control unit 10 of the intersection supply apparatus carries out a process for supply of the information in accordance with procedures shown in FIGS. 3 and 4. In the process executed by the control unit 10, the detecting signals from the vehicle speed sensor 11, the turn signals from the direction indicator 12, the information from the tag information receiver 13, and the table information and the condition maps as described above are used.

Referring to FIG. 3, the control unit 10 watches the information from the tag information receiver 13 and determines whether the information emitted by a tag installed on the road is received (S1). The tag information receiver 13 emits pulsed power in radio. While the vehicle is passing over a tag, the tag receiving the pulsed power emits the information (about the approaching direction to the intersection, a position L meters before the intersection and the like).

When it is determined that such tag information is received, the control unit 10 obtains a direction (an approaching direction) from which the vehicle is approaching the intersection and detects a position at which the vehicle is running (a position L meters before the intersection) (S2). With reference to the condition map (shown in FIG. 6 or FIG. 7), it is determined whether the vehicle speed calculated using the detected signals from the vehicle speed sensor 11 satisfies the transmission condition (is on or exceeds the first characteristic line Q1) (S3).

If the detected vehicle speed satisfies the transmission condition, it is determined, based on the signal from the direction indicator 12, what the passing state of the vehicle going to pass through the intersection is (S4). With reference to the table information (see FIG. 5), carriers corresponding to the approaching direction obtained from the tag information and the passing state obtained from the signal from the direction indicator 13 as described above are decided (S5).

The control unit 10 carries out the transmission control with the decided carriers (S6). As a result, the vehicle approaches and passes through the intersection under a condition in which the transmitter 20 transmits signals having the above decided carriers.

On the other hand, if the vehicle speed does not satisfy the transmission condition, the vehicle approaches the intersection under a condition in which the signal is not transmitted.

In the case shown in FIG. 1, a straight running vehicle $V_{A1}$ which is approaching the intersection from the tag Ta transmits the carrier signal a0. A right-turn vehicle $V_{A2}$ which is approaching the intersection from the same direction transmits the carrier signal a1. A straight running vehicle $V_{C1}$ which is approaching the intersection from the tag Tc transmits the carrier signal c0. A right-turn vehicle $V_{C2}$ which is approaching the intersection from the same direction transmits the carrier signal c1. In addition, a straight running vehicle $V_{D1}$ which is approaching the intersection from the tag Td transmits the carrier signal d0. Further, because vehicles $V_{B1}$ and $V_{B2}$ which stop before the intersection on the lane on which the tag Tb is installed do not satisfy the transmission condition (see FIG. 6 or FIG. 7), the carrier signal is not transmitted.

The transmission control of the carrier corresponding to the approaching direction of the vehicle to the intersection and the passing state of the vehicle at the intersection is carried out as described above. Further, it is determined, with reference to the condition map (see FIG. 6 or FIG. 7), whether the receiving condition is satisfied (S7). If the receiving condition is satisfied, a watching process for watching the signal carriers transmitted from the intersection information supply apparatus provided in each of other vehicles is carried out (S8). Based on the result of the watching process, it is determined whether a signal carrier is received by the receiver 30 (S9). If a signal carrier is received by the receiver 30, it is determined whether the received signal carrier is indicated, in the table information shown in FIG. 5, as a received carrier corresponding to the approaching direction of the vehicle to the intersection and the passing state of the vehicle at the intersection (S10). When the received signal carrier is indicated, in the table information, as the received carrier, the information about the received signal carrier is set in the control unit.

For example, in the case shown in FIG. 1, in the control unit 10 of the intersection information supply apparatus provided in the right-turn vehicle which is approaching the intersection from the tag Ta, information about the carrier c0 emitted from the straight running vehicle $V_{C1}$ approaching the intersection from the tag Tc and the carrier d0 emitted from the straight running vehicle $V_{D1}$ approaching the intersection from the tag Td are set.

In such a state, the control unit 10 determines, based on a running distance calculated using the signal (wheel speed pulses) output by the vehicle speed sensor 11 after obtaining the tag information in step S1, whether the vehicle has reached the intersection (S11). If the vehicle has not yet reached the intersection, the control unit 10 supplies a vehicle approaching message and a display control signal to the warning/display unit 40 (S12). As a result, the vehicle approaching message is displayed by the warning/display unit 40. The vehicle approaching message indicates that a vehicle is approaching from an approaching direction for which the carrier set in the control unit 10 as described above is defined as the transmission carrier in the table information (see FIG. 5).

For example, in the case shown in FIG. 1, in the right-turn vehicle $V_{A2}$ approaching the intersection from the tag Ta, the vehicle approaching message based on the received carriers c0 and d0 (see FIG. 5) is displayed by the warning/display unit 40. The vehicle approaching message indicates that the straight vehicle $V_{C1}$ from the tag Tc and the straight vehicle $V_{D1}$ from the tag Td are approaching.

The driver who looks at the vehicle approaching message displayed by the warning/display unit 40 recognizes that other vehicles are approaching and drives the vehicle to approach the intersection.

In a state where the vehicle approaching message is displayed by the warning/display unit 40, the process proceeds to steps shown in FIG. 4. In the process shown in FIG. 4, it is determined whether the information from the ending tag installed near the exit of the intersection is received (S21). It is then determined whether the calculated running distance of the vehicle after detecting the tag installed before the intersection reaches M meters (the distance between the tag and a corresponding ending tag), that is, whether the vehicle has passed through the intersection (S22). In addition, in a case where the receiving condition is not satisfied (NO in S7) or a case where no carrier is received from another vehicle (NO in S9), the vehicle approaching message as described above is not displayed and the above steps (S21 and S22) are executed.

In the above process, if it is determined that the vehicle has not yet passed through the intersection (NO in S21 and NO in S22), the process returns to step S3 shown in FIG. 2. The steps S3 through S12 described above are repeatedly executed. In the process, if it is determined, based on the calculated running distance, that the vehicle is in the intersection (YES in S11), the control unit 10 supplies a warning signal to the warning/display unit 40 in addition to the vehicle approaching message as described above. As a result, the warning/display unit 40 displays the vehicle approaching message in the same manner as in the above case and lights a warning lamp and outputs a warning sound.

Thus, the driver of the vehicle in the intersection is called to attention by the warning and can drive the vehicle to pass through the intersection paying attention to other vehicles approaching.

After this, if it is determined that the vehicle has passed the intersection (YES in S21, or NO in S21 and YES in S22), the transmission control of the carrier and watching process for the received carrier as described above are ended (S23). The process then returns to step S1 shown in FIG. 3 to provide for the process for the next intersection.

When the vehicle provided with the intersection information supply apparatus as described above is approaching the intersection and when the vehicle passes through the intersection in a passing state (the straight running state, the right-turn state or the left-turn state), the driver of the vehicle receives a message that another vehicle to pay attention to the approaching direction of the vehicle is approaching and a warning. Thus, the driver can drive the vehicle in safety based on the message and the warning.

The present invention is not limited to the aforementioned embodiments, and other variations and modifications may be made without departing from the scope of the claimed invention.

The present application is based on Japanese priority application No. 9-266842 filed on Sep. 30, 1997, the entire contents of which are hereby incorporated by reference.

What is claimed is:

1. An intersection information supply apparatus comprising:

a table indicating relationships between approaching directions of a vehicle to an intersection and signal forms;

approaching direction detecting means for detecting an approaching direction in which the vehicle is approaching the intersection;

transmission means for transmitting a signal having a signal form indicated in said table so as to correspond to the approaching direction detected by said approaching direction detecting means;

signal obtaining means for selectively obtaining, from among signals externally arriving at said vehicle, a signal having a signal form indicated in said table so as to correspond to an approaching direction relevant to the approaching direction detected by said approaching direction detecting means; and information output means for outputting information about presence of another vehicle when said signal obtaining means obtains the signal.

2. The intersection information supply apparatus as claimed in claim 1 further comprising:

running state detecting means for detecting a running state of said vehicle; and transmission control means for controlling, based on the running state detected by said running state detecting means, whether said transmission means transmits the signal.

3. The intersection information supply apparatus as claimed in claim 2, wherein the running state to be detected by said running state detecting means includes a vehicle speed, and wherein said transmission control means controls, based on vehicle speeds detected at respective positions before the intersection, whether said transmission means transmits the signal.

4. The intersection information supply apparatus as claimed in claim 1, wherein the table indicates relationships between passing states of said vehicle and the signal forms for each of the approaching directions, each of the passing states of said vehicle representing how said vehicle passes through the intersection, said intersection information supply apparatus further comprising:

determination means for determining a passing state in which said vehicle is going to pass through the intersection, wherein said transmission means transmits the signal having the signal form indicated in said table so as to correspond to the approaching direction detected by said approaching direction detecting means and the passing state determined by said determination means, and wherein said signal obtaining means selectively obtains the signal having the signal form indicated in said table so as to correspond to a passing state in another approaching direction relevant to the approaching direction detected by said approaching direction detecting means and the passing state determined by said determination means.

5. The intersection information supply apparatus as claimed in claim 4, wherein said determination means determines the passing state based on a signal from a direction indicator of said vehicle.

6. The intersection information supply apparatus as claimed in claim 1, wherein each of the signal forms is defined based on a frequency.

7. An intersection information supply apparatus comprising:

a table indicating relationships between approaching directions of a vehicle to an intersection and signal forms;

an approaching direction detecting unit detecting an approaching direction in which the vehicle is approaching the intersection;

a transmission unit transmitting a signal having a signal form indicated in said table so as to correspond to the approaching direction detected by said approaching direction detecting unit;

a signal obtaining unit selectively obtaining, from among signals externally arriving at said vehicle, a signal having a signal form indicated in said table so as to correspond to an approaching direction relevant to the approaching direction detected by said approaching direction detecting unit; and an information output unit outputting information about presence of another vehicle when said signal obtaining unit obtains the signal.

8. The intersection information supply apparatus as claimed in claim 7 further comprising:

a running state detecting unit detecting a running state of said vehicle; and a transmission control unit controlling, based on the running state detected by said running state detecting means, whether said transmission unit transmits the signal.

9. The intersection information supply apparatus as claimed in claim 8, wherein the running state to be detected by said running state detecting unit includes a vehicle speed, and wherein said transmission control unit controls, based on vehicle speeds detected at respective positions before the intersection, whether said transmission unit transmits the signal.

10. The intersection information supply apparatus as claimed in claim 7, wherein the table indicates relationships between passing states of said vehicle and the signal forms for each of the approaching directions, each of the passing states of said vehicle representing how said vehicle passes through the intersection, said intersection information supply apparatus further comprising:

a determination unit determining a passing state in which said vehicle is going to pass through the intersection, wherein said transmission unit transmits the signal having the signal form indicated in said table so as to correspond to the approaching direction detected by said approaching direction detecting unit and the passing state determined by said determination unit, and wherein said signal obtaining unit selectively obtains the signal having the signal form indicated in said table so as to correspond to a passing state in another approaching direction relevant to the approaching direction detected by said approaching direction detecting unit and the passing state determined by said determination unit.

11. The intersection information supply apparatus as claimed in claim 10, wherein said determination unit determines the passing state based on a signal from a direction indicator of said vehicle.

12. The intersection information supply apparatus as claimed in claim 7, wherein each of the signal forms is defined based on a frequency.

* * * * *